US006575588B2

(12) United States Patent
Strehl

(10) Patent No.: US 6,575,588 B2
(45) Date of Patent: Jun. 10, 2003

(54) LAMP DEVICE WHICH IS WORN ON THE HEAD

(76) Inventor: Bernhard Strehl, 6 Sandgrubenweg, A-8055 Neu-Seiersberg (AT)

( * ) Notice: Subject to any disclaimer, the term of this patent is extended or adjusted under 35 U.S.C. 154(b) by 0 days.

(21) Appl. No.: 10/084,980

(22) Filed: Mar. 1, 2002

(65) Prior Publication Data

US 2002/0089844 A1 Jul. 11, 2002

Related U.S. Application Data

(63) Continuation of application No. PCT/AT00/00226, filed on Aug. 25, 2000.

(30) Foreign Application Priority Data

Sep. 2, 1999 (AT) ..... 1517/99

(51) Int. Cl.[7] ..... F21V 21/084
(52) U.S. Cl. ..... 362/105
(58) Field of Search ..... 362/105, 250, 362/419, 427, 106, 234, 238, 249, 190, 191, 572, 225

(56) References Cited

U.S. PATENT DOCUMENTS 2,411,568 A * 11/1946 Foote ..... 362/105
3,350,552 A 10/1967 Lawrence
4,234,910 A * 11/1980 Price ..... 362/105
5,331,357 A 7/1994 Cooley et al.
5,408,393 A * 4/1995 Becker ..... 362/105
5,567,039 A 10/1996 Sims
5,667,291 A 9/1997 Caplan et al.
5,722,762 A 3/1998 Soll
6,290,368 B1 * 9/2002 Lehrer ..... 362/105

* cited by examiner

*Primary Examiner*—Sandra O'Shea
*Assistant Examiner*—Bao Q. Truong
(74) *Attorney, Agent, or Firm*—Dickstein Shapiro Morin & Oshinsky, LLP

(57) ABSTRACT

The invention relates to a lamp device which is worn on or directly in front of the forehead, respectively, or above or beside the eyes, respectively, and which ensures that the wearer's freedom of movement is neither restricted nor hindered by cables or other connections. The present invention is special in that several non-thermal, light-emitting elements are provided for the generation of light and that the individual light-emitting elements emit the light in a defined direction of radiation and are located in such a way that the light which is generated is directional. The light-emitting elements are located in such a way that each of them forms a particular angle with the visual axis of the wearer so that all light sources have a common intersection point just at the wearer's monitoring or working distance, respectively. Moreover, all individual light-emitting elements have the same distance to that intersection point. Furthermore, the vertical position of the area of illumination may be varied in front of the wearer's face.

7 Claims, 7 Drawing Sheets

LAMP DEVICE WHICH IS WORN ON THE HEAD

This application is a continuation of international application number PCT PCT/AT00/00226 filed Aug. 25, 2000, the entire disclosure of which is herein incorporated by reference.

BACKGROUND OF THE INVENTION

1. Field of the Invention

The invention relates to a lamp device which is worn on or directly in front of the forehead, respectively, or above or beside the eyes, respectively, e.g., for medical applications in order to illuminate an area of treatment, comprising an integrated energy supply device, characterized in that several non-thermal, light-emitting elements are provided as a light source and that the individual light-emitting elements emit the light in a defined direction of radiation and are located in such a way that the light which is generated is directional.

The subject matter of the invention is a lamp which is worn on or directly in front of the forehead, respectively, or above or beside the eyes, respectively, and which ensures that the wearer's freedom of movement is neither restricted nor hindered by cables or other connections. Such a lamp is intended, e.g., for medical applications in order to illuminate the area of treatment during diagnosis or treatment. However, the lamp is also usable for non-medical applications involving similar problems of illumination.

2. Description of the Related Art

Lamps and lamp devices worn on the head were designed in various embodiments, in particular for medicine. Thereby, the light is generated either a) directly in front of or on the head of the wearer, or b) in an external light source and is conducted via light guides made of glass, a synthetic material or a liquid to the side of the wearer's forehead. In case of b), the wearer's freedom of movement is more or less hindered or restricted, respectively, by the optical cable, and the weight of the light guide creates an unpleasant drawing stress leading to muscle strains in the back of the neck, to headaches or to other premature symptoms of fatigue. In case of a), cable-free sources of energy, which allow the wearer to move unrestrictedly, are indeed also used but the light sources used are of a thermal nature, which leads to a substantial heat development in front of and above the wearer's forehead. Furthermore, the process of light generation takes place with small efficiency so that the packages of accumulators or the batteries, which usually are used, are relatively heavy, which again leads to the above-mentioned symptoms of fatigue. In addition, the light coming from the thermal light sources must first be concentrated by means of suitable optical instruments, which causes those headlamps to have relatively large weights and inconvenient dimensions.

SUMMARY OF THE INVENTION

It is the object of the invention to avoid the above-described insufficiencies of conventional headlamps, and the invention is characterized in that several non-thermal, light-emitting elements are provided as a light source and that the individual light-emitting elements emit the light in a defined direction of radiation and are located in such a way that the light which is generated is directional. Thus, it is advantageous that 1. the generation of light occurs directly on the head, i.e., in front of the forehead, above the eyes or besides the eyes of the wearer, by means of non-thermal, light-emitting elements. Preferably, those light sources are designed as light-emitting semiconductors whose radiation is modified such that the human eye receives an impression of white light. On the one hand, that guarantees high efficiency during the transformation of electric energy into light, and, on the other hand, the radiation of light is strongly directional, due to the mode of action and the structure of those light-emitting semiconductors. That directionality of the radiated light is utilized in the present invention, that is, in so far as:
2. several of those light-emitting elements are used, which
3. are located in such a way that the direction of radiation of each individual light-emitting element forms an angle with the visual axis of the wearer in such a manner that the center axis of radiation of all light-emitting elements has a common intersection point on the plane of symmetry of the wearer's eyes at the desired monitoring or working distance, respectively, and
4. the distance of the individual light-emitting elements to that common intersection point is equal for all elements, and furthermore
5. the light-emitting elements are mounted such that the wearer may adapt the level of position of the illumination field generated in accordance with items 2 to 4 to his monitoring or working requirements, respectively.

BRIEF DESCRIPTION OF THE DRAWINGS

The above-mentioned features and advantageous characteristics of the headlamp of the invention become even more apparent from the attached drawings of preferred basic arrangements and several preferred embodiments. In detail, the drawings depict the following.

DETAILED DESCRIPTION OF THE PREFERRED EMBODIMENT

Figure 1:
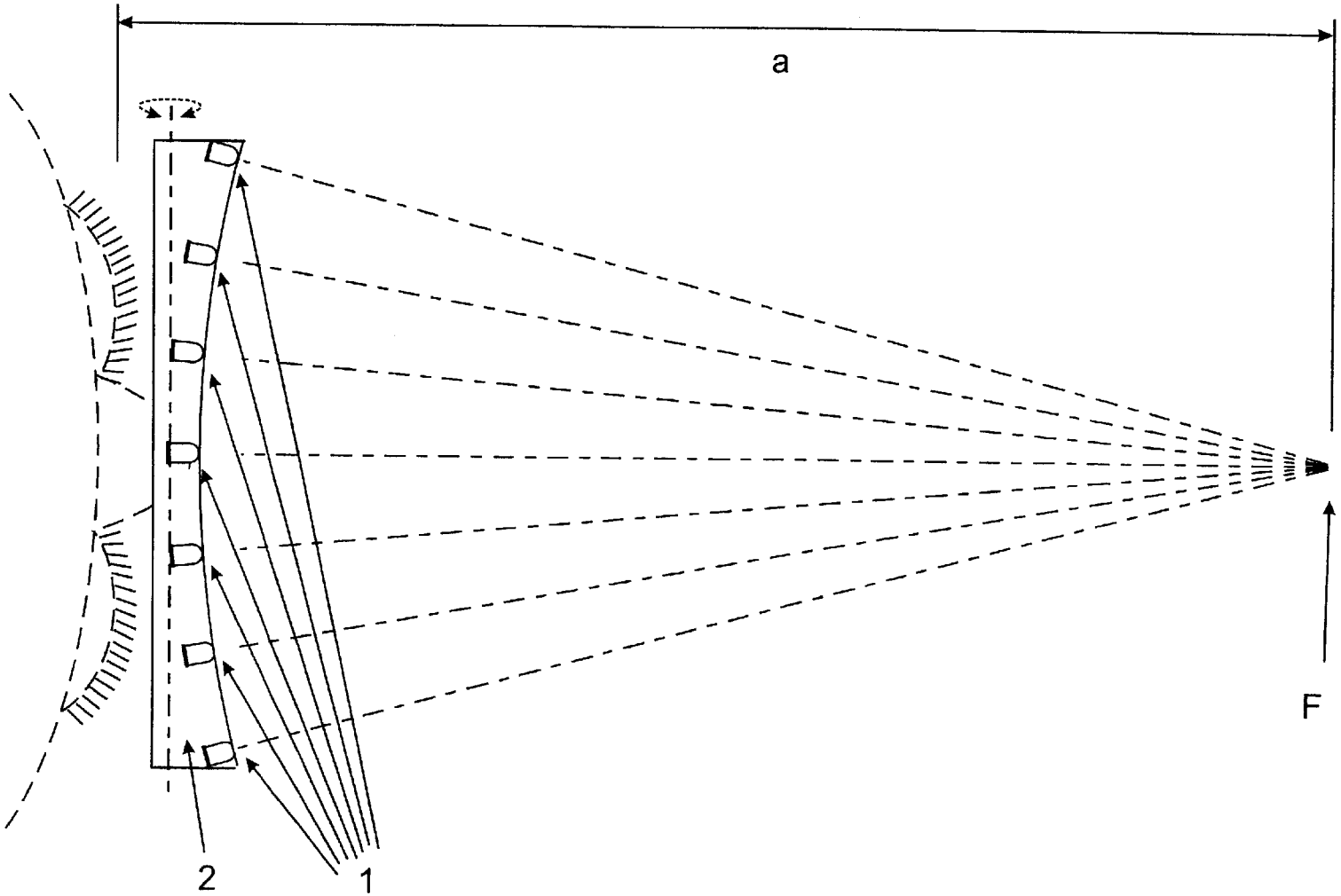
FIG. 1 is a top view of the preferred embodiment of the present invention showing the light-emitting elements.

Referring to FIG. 1, a preferred basic arrangement of the invention is shown, in which light-emitting elements 1 are arranged above the user's eyes on a support piece 2 in such a way that the center axes of radiation of the light-emitting elements have a common intersection point F on the plane of symmetry of the wearer's eyes. Thereby, the mounting of the light-emitting elements 1 on the support piece 2 may be effected such that the distance a of the intersection point F to the wearer's eyes may be varied. The support piece 2 is rotatable around an axis at a right angle to the plane of symmetry of the eyes.

Figure 2:
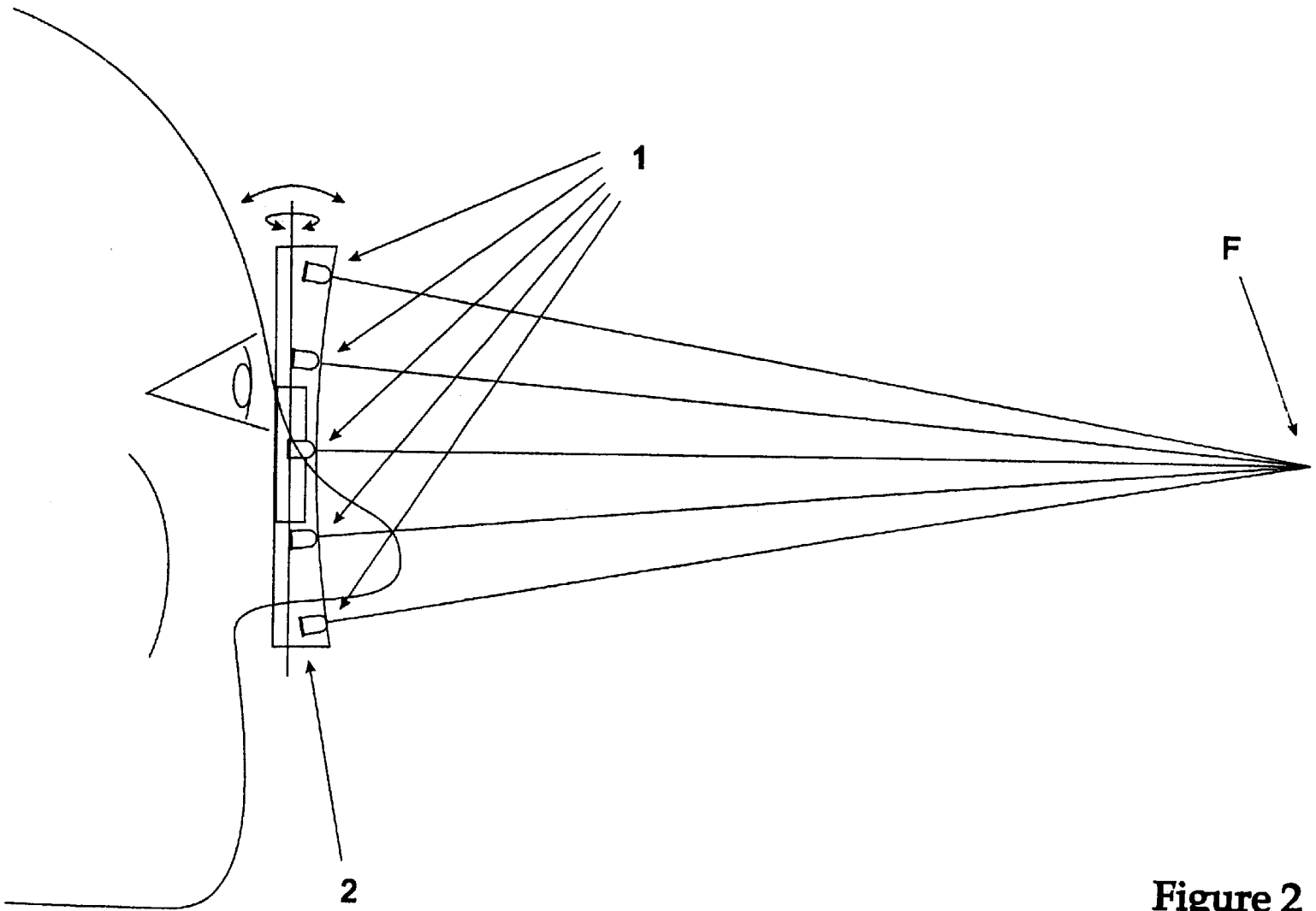
FIG. 2 is a side view of another embodiment of the present invention showing the light-emitting elements.

Turning to FIG. 2, a further preferred basic arrangement of the invention is shown, in which the light-emitting elements 1 are arranged beside the eyes on a support piece 2 on the left-hand side or on the right-hand side or on two support pieces 2 on the left-hand side and on the right-hand side. The center axes of radiation of all light-emitting elements also have a common intersection point F on the plane of symmetry of the wearer's eyes. The support piece (s) 2 is/are mounted to be rotatable around a vertical axis and, additionally, to be inclinable around a horizontal axis.

Figure 3B:
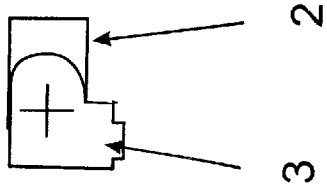
FIGS. 3*a*, 3*b* and 3*c* are the front, top and side views, respectively, of the preferred embodiment of the invention.
Figure 3A:
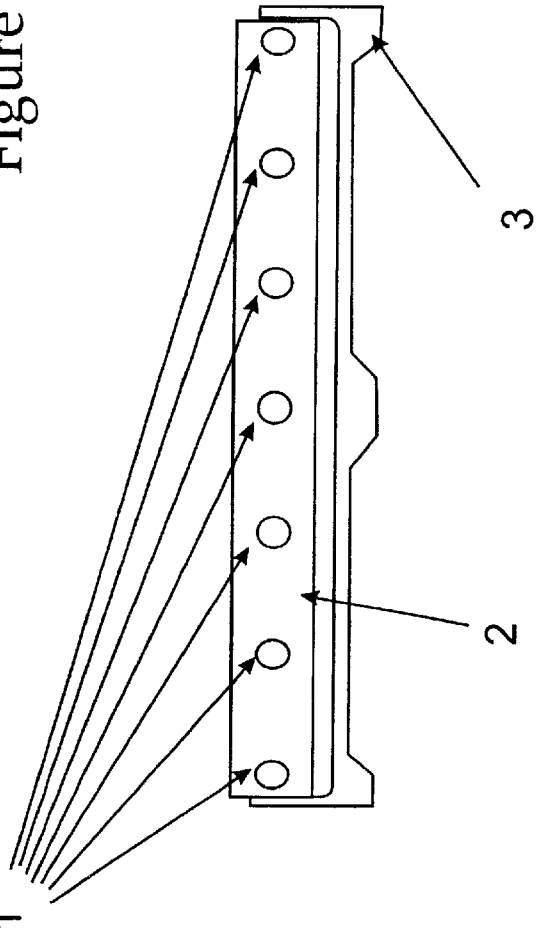
Figure 3C:
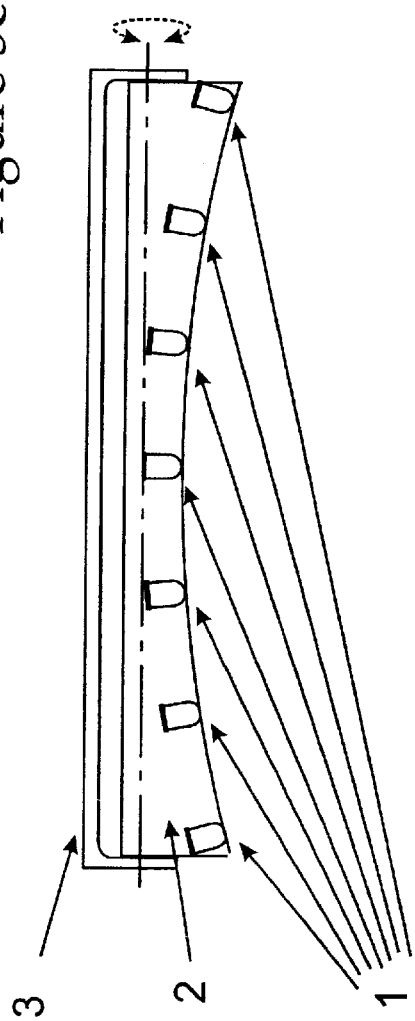

Referring now to FIG. 3, a preferred embodiment of the invention is shown in which the arrangement of the light-emitting elements 1 is achieved in that they are mounted on a support piece 2, which is mounted to a further holding piece 3 in a vertically pivotable fashion, which itself may be fastened in a detachable manner to the upper rim of spectacles or of an eye shield. The current supply device and the switch are housed in an external housing, which, e.g., is worn on the wearer's belt.

Figure 4A:
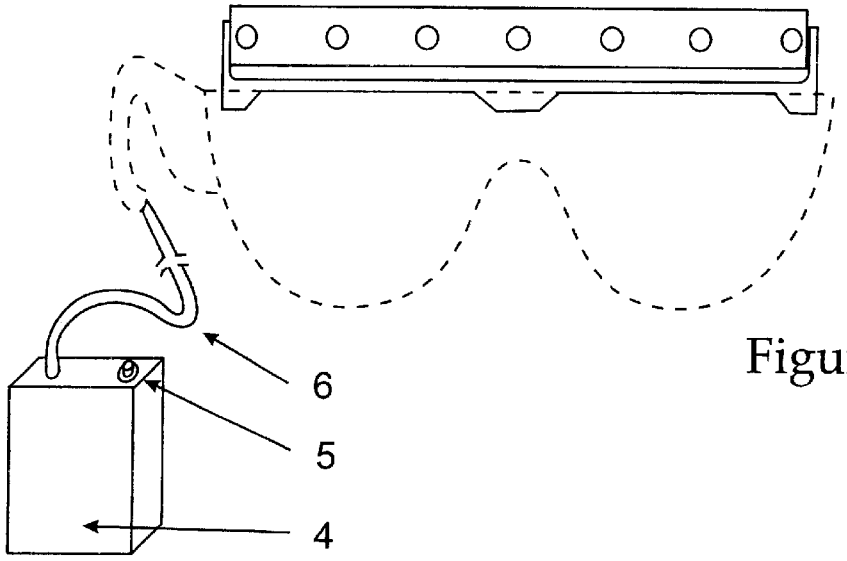
FIGS. 4*a* and 4*b* are two possible variants of fastening the preferred embodiment of the invention as well as the power supply source.
Figure 4B:
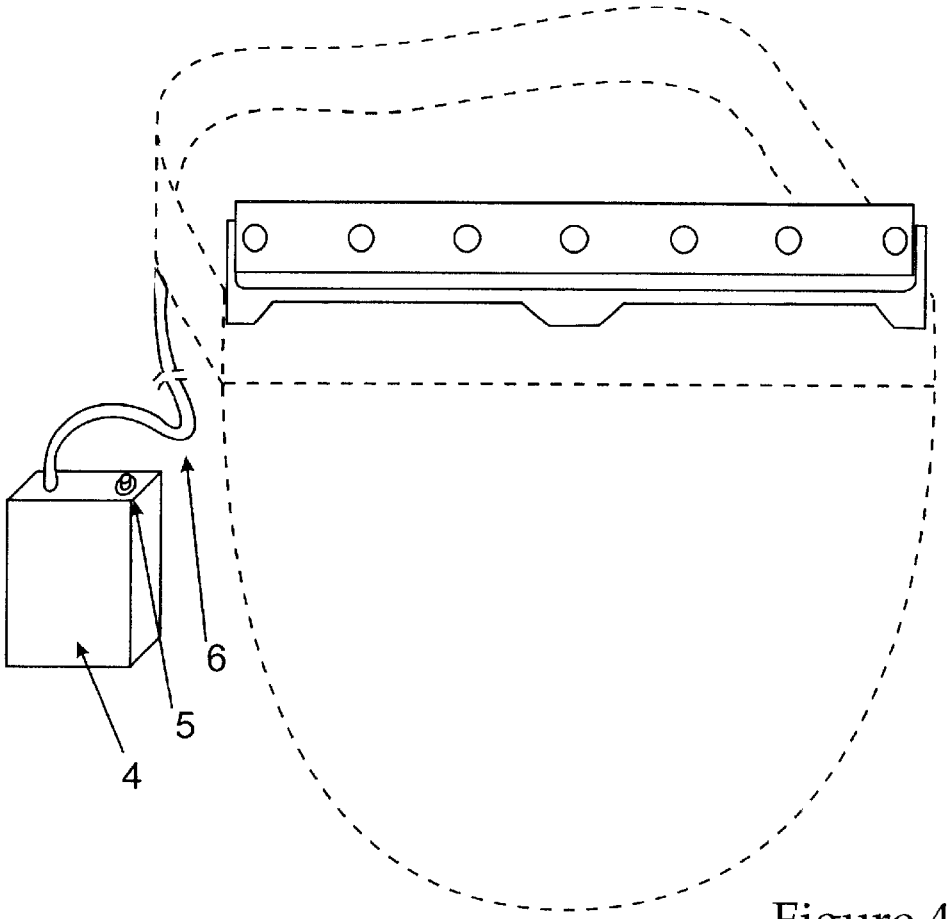

FIG. 4 shows two possible variants of fastening the preferred embodiment depicted in FIG. 3. FIG. 4*a* shows fastening to the upper rim of spectacles, which may be effected by clipping. The current supply device 4 and the switch 5 are housed in an external housing, which e.g., is worn on the wearer's belt. Current supply takes place via a line 6 which is conducted along one of the bows of the spectacles. FIG. 4*b* shows fastening to an eye shield, also e.g., by clipping. Current supply takes place via a line which is conducted in the area of the head along the fastening band of the protective shield.

Figure 5:
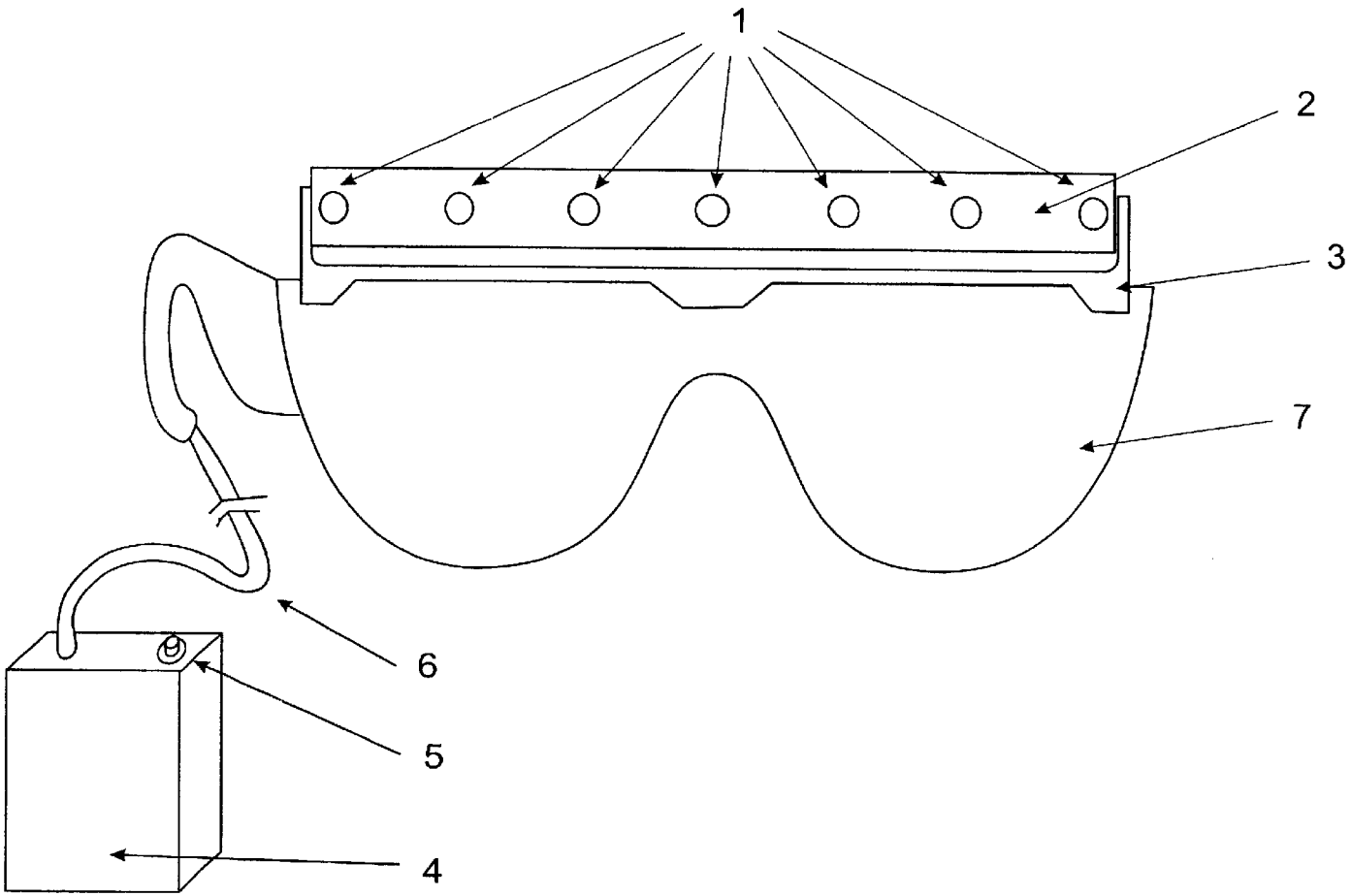
FIG. 5 is a front view of a preferred embodiment of the invention in which the light-emitting elements are fastened to the upper rim of a pair of spectacles.

FIG. 5 shows a further preferred embodiment in which the light-emitting elements are fastened to the upper rim of spectacles 7. The fastening is nondetachable so that the lamp and the spectacles 7 form a unit. The light-emitting elements 1 are mounted to a support piece 2, which is mounted to a further holding piece 3 in a vertical pivotable fashion. The holding piece 3 is securely fixed to the upper spectacle frame 7. The current supply device 4 and the switch 5 are housed in an external housing, which, e.g., is worn on the wearer's belt. Current supply takes place via a line 6 which is conducted along one of the bows of the spectacles.

Figure 6:
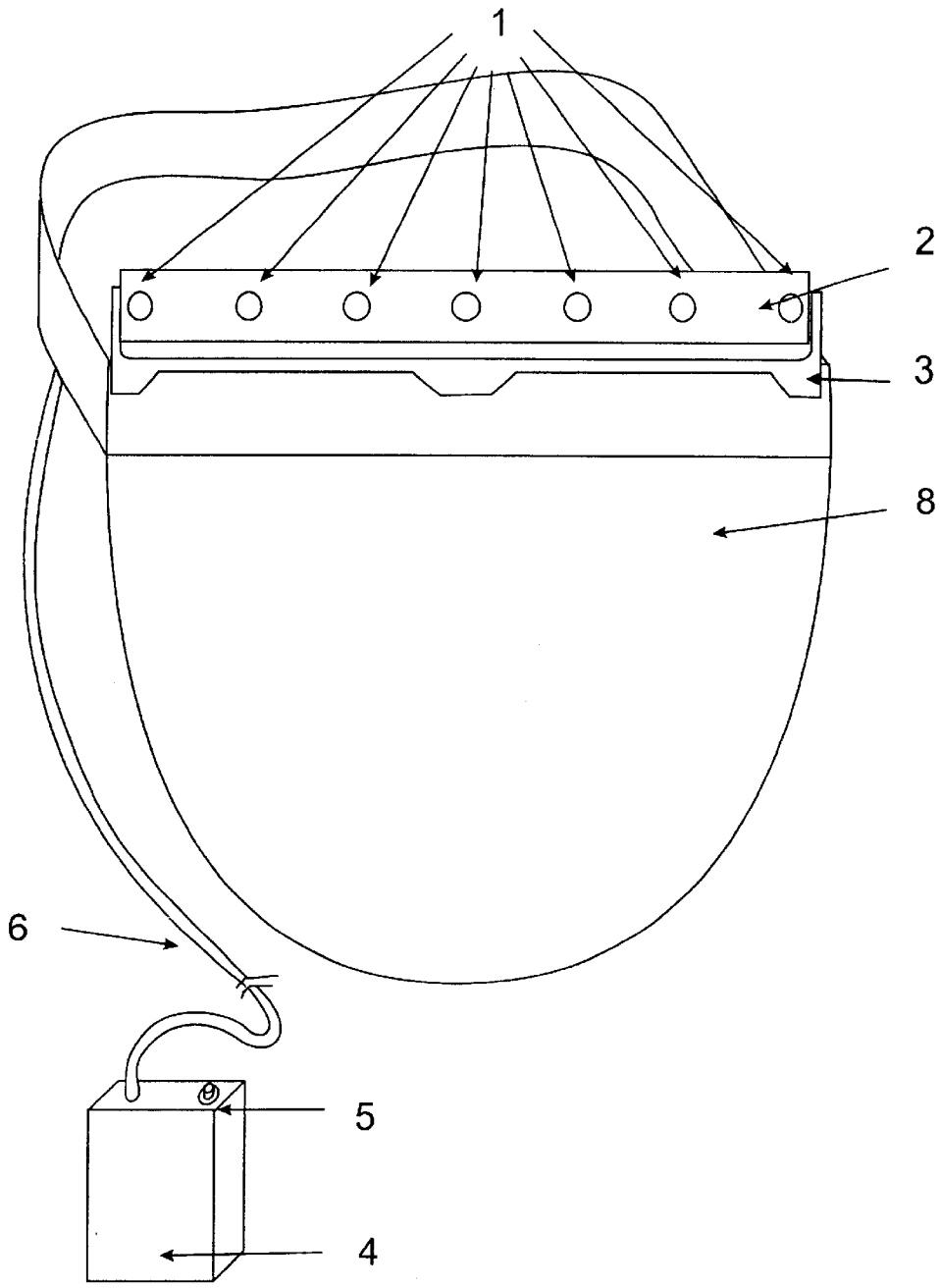
FIG. 6 is a front view of a preferred embodiment of the invention in which the light-emitting elements are fastened to the rim of an eye shield.

FIG. 6 shows a further preferred embodiment in which the light-emitting elements are fastened to the upper rim of an eye shield 8. That kind of fastening is nondetachable so that the lamp and the eye shield 8 form a unit. The light-emitting elements 1 are mounted to a support piece 2, which is mounted to a further holding piece 3 in a vertical pivotable fashion. The holding piece 3 is securely fixed to the upper rim of the eye shield 8. The current supply device 4 and the switch 5 are housed in an external housing, which, e.g., is worn on the wearer's belt. Current supply takes place via a line 6, which is in the area of the head along the fastening band of the eye shield.

Figure 7:
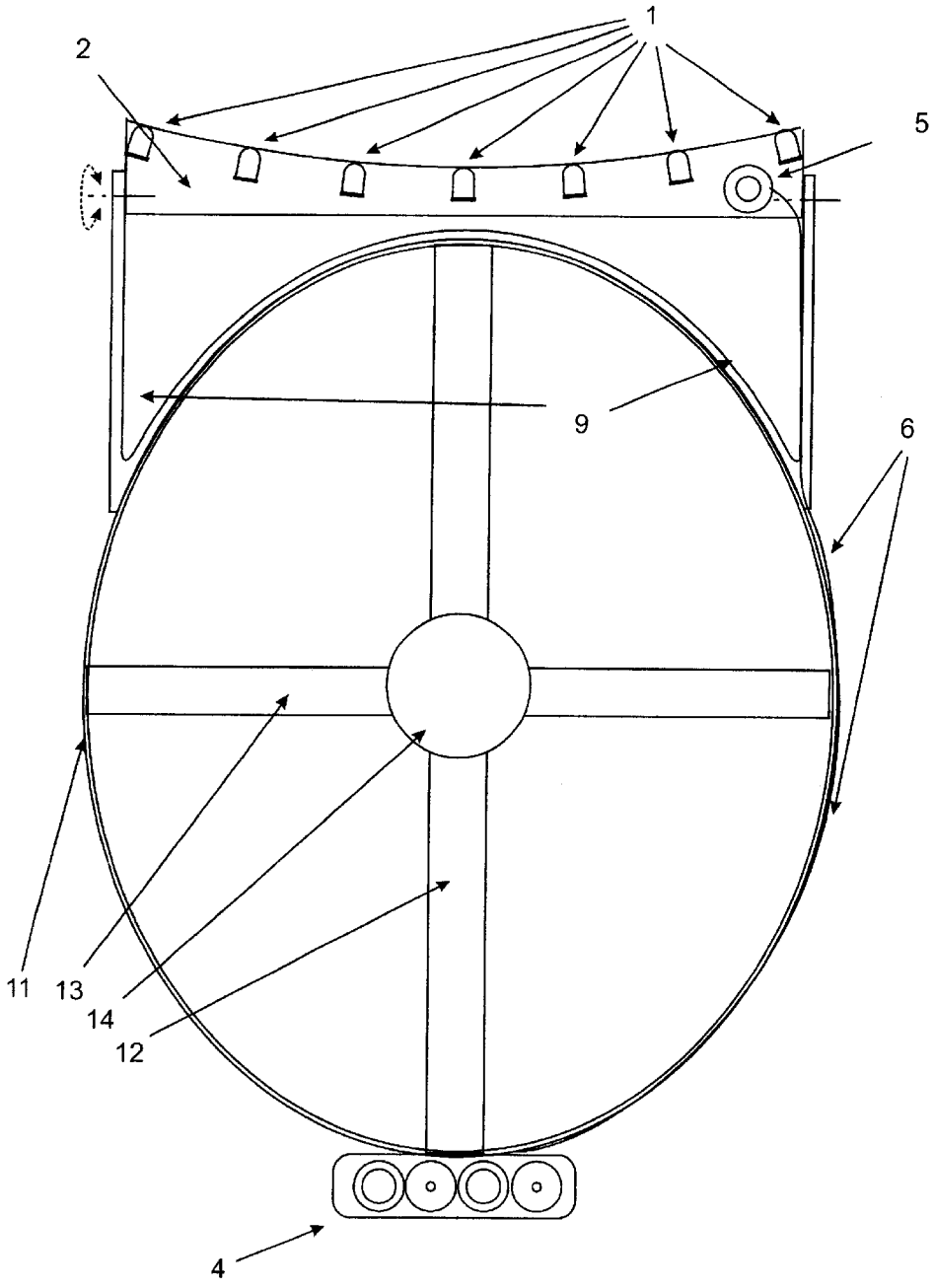
FIG. 7 is a top view of a preferred embodiment of the invention in which the light-emitting elements and power source are mounted to a separate head carrier.

FIG. 7 shows a further preferred embodiment in which the light-emitting elements 1 are mounted to a separate head carrier. The light-emitting elements 1 are mounted to a holding piece 2, which is fastened to a support 9 in such a way that the illumination field may be displaced in a vertical direction and thus may be adapted to the wearer's monitoring requirements. The head carrier is composed of an adjustable headband 11, which is prevented from slipping off by two additional bands (a longitudinal one 12 and a transverse one 13). The lengths of those two additional bands are also adjustable, namely at their crossing point 14. In the area of the forehead, a support 9 is securely connected to the headband 11, with the holding piece 2 being rotatably fastened to the two arms of the latter. In the area of the back of the head, the current supply device 4 is housed, which may be provided either in the form of batteries or of rechargeable accumulators. Fitting just opposite the pivotable piece on the side of the forehead makes feasible an at least partial balancing of the weight and thus a decrease of the muscle strains in the back of the neck of the person wearing the lamp device. Current supply from the current supply device 4) to the light-emitting elements takes place via a bipolar line 6 which is conducted from the batteries, along the head band, across the right arm of the support, to a switch 5. The switch 5 is housed on the upper right in the holding piece 2 so that it may be operated effortlessly with the right hand while the lamp device is worn on the head.

With the arrangement according to the invention of the light-emitting elements 1, it is guaranteed that the light generated non-thermally with great efficiency is utilized as best as possible for the illumination of the monitoring or working areas, respectively. That leads to the fact that, on the one hand, the weight of the described headlamp may be kept to a minimum, since the energy sources and energy storage devices, respectively, necessary for the energy supply may have very small sizes, and, on the other hand, the disturbing generation of heat in front of or on the head of the wearer, respectively, is reduced to a minimum. That guarantees most comfortable wearing. Furthermore, the use of several light-emitting elements 1 guarantees that any tools and instruments which are used in the monitoring area while working with the described headlamp can block the illuminating light only partially, which is why sufficient illumination is ensured at all times.

What is claimed is:

1. A lamp device which is worn on a user's head to illuminate an area in front of the user, comprising a light source formed of a plurality of individual, non-thermal, light-emitting elements that generate and emit light in a defined direction of radiation and are located in such a way that the light which is generated is directional, wherein said plurality of light-emitting elements are located on a support piece which is pivotable.

2. A headlamp according to claim 1, wherein the support piece is pivotable in a vertical direction.

3. A headlamp according to claim 1, wherein the support piece is pivotable in a horizontal direction.

4. A headlamp according to claim 1, wherein all light-emitting elements are located on a single support piece.

5. A headlamp according to claim 1, wherein the individual light-emitting elements are located in such a way that the axis of radiation of each individual light-emitting element forms an angle with the visual axis of a wearer in such a manner that the center axis of radiation of all light-emitting elements has a common intersection point on the plane of symmetry of the wearer's eyes at the desired monitoring or working distance, respectively.

6. A headlamp according to claim 1, wherein the individual light-emitting elements are located in such a way that they all have the same distance to the illumination field.

7. A headlamp according to claim 1, wherein the headlamp comprises an integrated energy supply device.

* * * * *